US008143546B2

(12) United States Patent
De France

(10) Patent No.: US 8,143,546 B2
(45) Date of Patent: Mar. 27, 2012

(54) ELECTRICAL SWITCH

(75) Inventor: Robert V. De France, Poughkeepsie, NY (US)

(73) Assignee: Hubbell Incorporated, Shelton, CT (US)

( * ) Notice: Subject to any disclaimer, the term of this patent is extended or adjusted under 35 U.S.C. 154(b) by 355 days.

(21) Appl. No.: 12/454,349

(22) Filed: May 15, 2009

(65) Prior Publication Data

US 2010/0006414 A1 Jan. 14, 2010

Related U.S. Application Data

(60) Provisional application No. 61/134,475, filed on Jul. 9, 2008.

(51) Int. Cl.
*H01H 1/42* (2006.01)

(52) U.S. Cl. ..... 200/554

(58) Field of Classification Search ..... 200/554, 200/17 R, 48 R–48 CB, 561, 330–331, 50.1; 439/783, 477, 188; 174/135, 138 R, 146, 174/169, 177; 218/10
See application file for complete search history.

(56) References Cited

U.S. PATENT DOCUMENTS

| | | | | |
|---|---|---|---|---|
| 2,714,646 | A | 8/1955 | Jamison | 200/162 |
| 3,746,819 | A | 7/1973 | Linde | 200/170 A |
| 5,581,051 | A * | 12/1996 | Hill | 174/138 R |
| 5,921,794 | A * | 7/1999 | Koch | 439/188 |
| 7,196,279 | B1 | 3/2007 | Roberts | 200/48 R |
| 7,943,871 | B2 * | 5/2011 | Crutcher | 200/17 R |
| 2007/0295691 | A1 | 12/2007 | Crutcher | 218/10 |
| 2008/0026644 | A1 | 1/2008 | De France et al. | 439/783 |

OTHER PUBLICATIONS

"AMPACT In-Line Disconnect Assemblies, Instruction Sheet 408-4097", Feb. 28, 1996, 4 pgs.

* cited by examiner

*Primary Examiner* — Edwin A. Leon
(74) *Attorney, Agent, or Firm* — Harrington & Smith

(57) ABSTRACT

An electrical switch including a first section; a second section; and a contact arm rotatably connected to the first section. An end of the contact arm is movable between an open position spaced from the second section and a closed position contacting the second section. The second section includes a cam assembly configured to assist in moving the end of the contact arm between the open and closed positions.

20 Claims, 8 Drawing Sheets

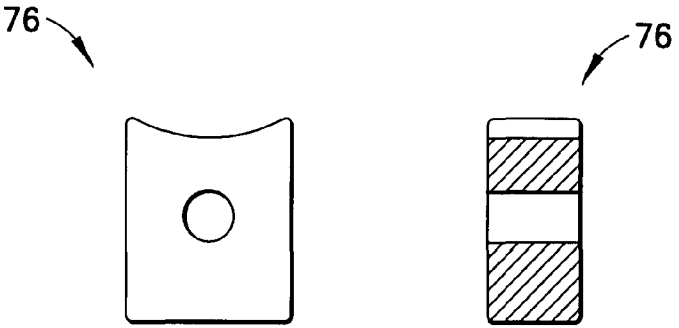
FIG.11
FIG.12
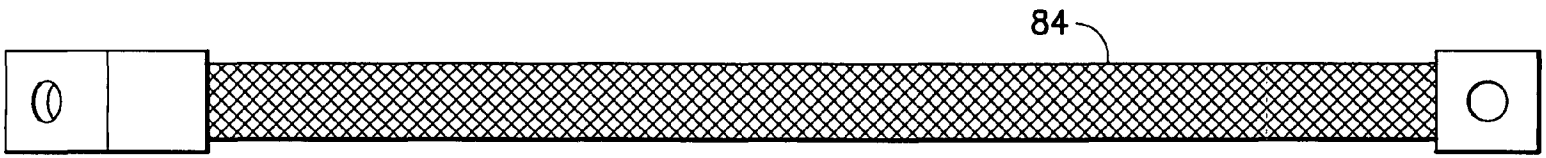
FIG.13
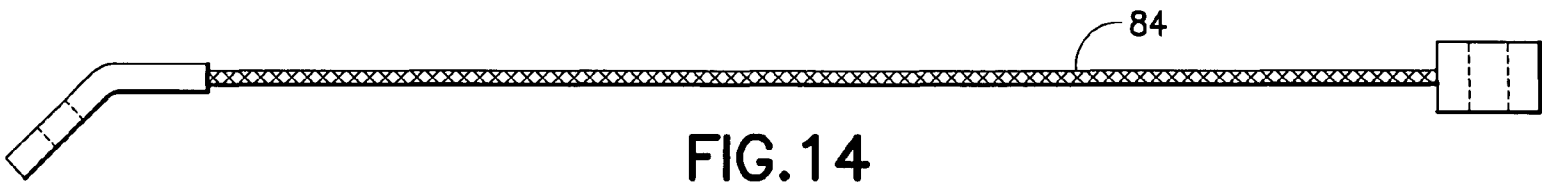
FIG.14

ELECTRICAL SWITCH

CROSS REFERENCE TO RELATED APPLICATION

This application claims priority under 35 U.S.C. §119(e) on U.S. Provisional Patent Application No. 61/134,475 filed Jul. 9, 2008 which is hereby incorporated by reference in its entirety.

BACKGROUND OF THE INVENTION

1. Field of the Invention

The invention relates to an electrical switch and, more particularly, to an electrical switch with a movable contact arm.

2. Brief Description of Prior Developments

In the electrical industry, it is sometimes necessary to stop the flow of electricity through conductors. This is often done with some type of switch. One particular type of switch is a knife blade switch. A knife blade switch uses a contact arm or knife blade which is pivoted between open and closed positions.

U.S. Patent Publication Nos. 2007/0295691 A1 and 2008/0026644 A1 disclose in-line vacuum reclosers used in overhead high voltage electrical distribution lines. An in-line switch for overhead high voltage electrical distribution lines has the advantage of not needing to be directly supported on a utility pole or tower. The in-line switch can be supported above ground by suspension between ends of two electrical conductor lines. However, because the switch is suspended between two electrical conductor lines, the switch might twist and move when attempting to open and close the contact arm of the switch.

SUMMARY

The following summary is merely intended to be exemplary. The summary is not intended to limit the scope of the claimed invention.

In accordance with one aspect of the invention, an electrical switch is provided including a first section; a second section; and a contact arm rotatably connected to the first section. An end of the contact arm is movable between an open position spaced from the second section and a closed position contacting the second section. The second section includes a cam assembly configured to assist in moving the end of the contact arm between the open and closed positions.

In accordance with another aspect of the invention, an electrical switch is provided comprising a first section, a second section, an electrical insulator, and a contact arm. The first section comprises a first frame configured to be connected to a first electrical conductor. The second section comprises a second frame configured to be connected to a second electrical conductor. The electrical insulator is connected between the first and second sections such that the first section, the second section and the electrical insulator can be suspended in series between the first and second electrical conductors. The contact arm is pivotably connected to the first section. An end of the contact arm is movable between a closed position relative to the second section to provide an electrical path between the first and second sections, and an open position relative to the second section. The second section comprises a spring loaded cam assembly configured to assist in moving the end of the contact arm between the open and closed positions. The cam assembly comprises a cam member slidably mounted to the second frame and a spring providing a biasing force against the frame member.

In accordance with another aspect of the invention, a method is provided comprising providing a first electrical connection section comprising a first frame; providing a second electrical connection section comprising a second frame and a cam assembly connected to the second frame; rotatably connecting a contact arm to the first electrical connection section; and connecting the second electrical connection section to the first electrical connection section by an insulator section. An end of the contact arm is movably between an open position spaced from the second section and a closed position contacting the second section. The cam assembly is configured to assist in moving the end of the contact arm between the open and closed positions.

BRIEF DESCRIPTION OF THE DRAWINGS

The foregoing aspects and other features of the invention are explained in the following description, taken in connection with the accompanying drawings, wherein:

FIG. 11 is a side view of the contact plate shown in FIG. 10;

FIG. 12 is a cross sectional view of the contact plate shown in FIG. 11;

FIG. 13 is a top plan view of the electrical conductor shown in FIG. 3;

FIG. 14 is a side view of the conductor shown in FIG. 13;

DETAILED DESCRIPTION OF EMBODIMENT

Figure 1:
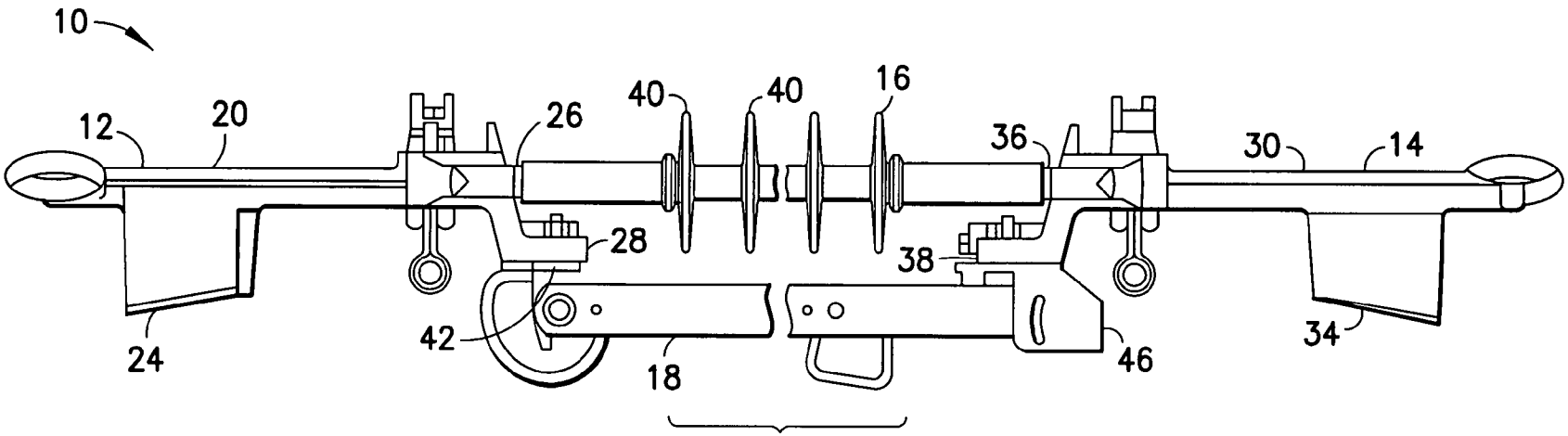
FIG. 1 is a side view of an apparatus comprising features of the invention.

Referring to FIG. 1, there is shown a side view of an apparatus 10 incorporating features of the invention. Although the invention will be described with reference to the example embodiment shown in the drawings, it should be understood that the invention can be embodied in many alternate forms of embodiments. In addition, any suitable size, shape or type of elements or materials could be used.

Figure 2:
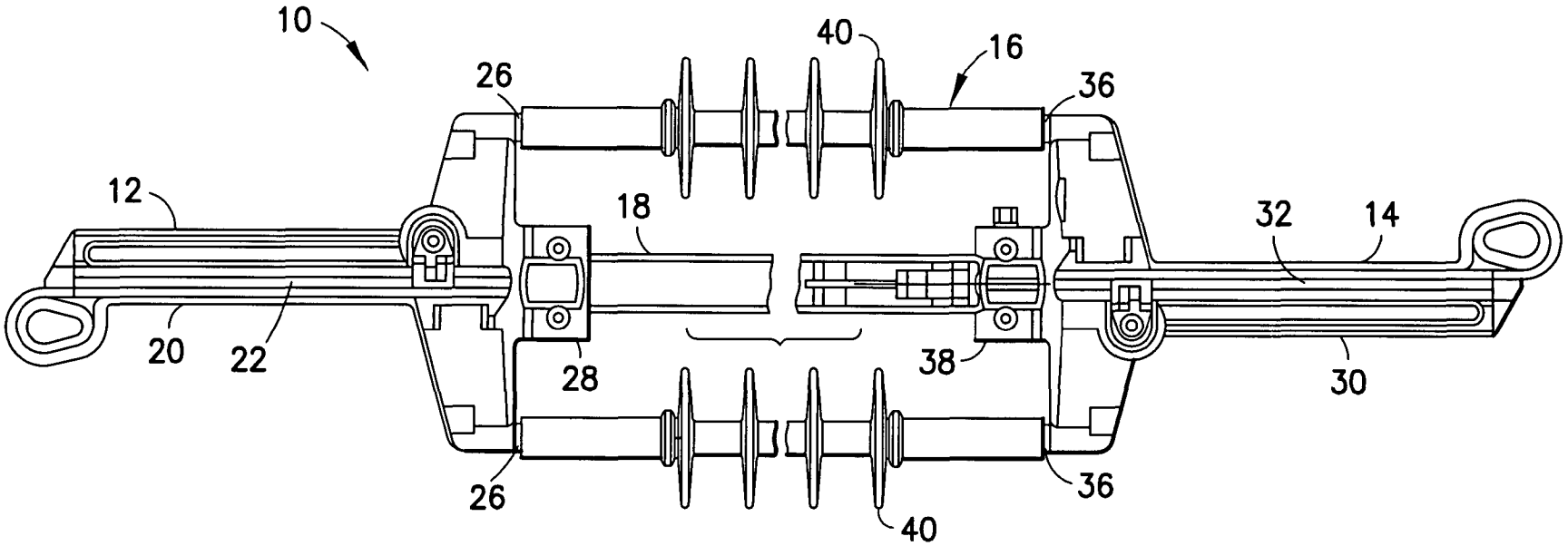
FIG. 2 is a top plan view of the apparatus shown in FIG. 1.

The apparatus 10 is an electrical switch. More specifically, in this embodiment the switch is an in-line switch which is connected and suspended between two conductors, such as overhead high voltage electrical distribution lines (not shown). Referring also to FIG. 2, the switch 10 generally comprises a first section 12, a second section 14, an electrical insulating section 16 and a movable contact arm 18. In one type of embodiment the contact arm 18 could comprise a vacuum recloser and the switch could include a controller, such as disclosed in U.S. Patent Publication Nos. 2007/0295691 A1 and 2008/0026644 A1 which are hereby incorporated by reference in their entireties.

The first section 12 generally comprises a first frame member 20. In this embodiment the first frame member 20 is a one piece member, such as comprised of cast metal for example. However, in an alternate embodiment the first frame member could be comprised of multiple members. The first frame member 20 comprises a channel 22 for receiving an end of the first electrical conductor (not shown). The first frame member 20 also comprises an integrally formed wedge shaped section 24. The wedge shaped section 24 is configured for use with a wedge connector shell (not shown) for attaching the first electrical conductor to the first frame member. However, in alternate embodiments, any suitable system could be provided for attaching the first electrical conductor to the first frame member 20. The first frame member comprises two leg sections 26 and a bottom platform section 28.

The second section 14 has a second frame member 30 which is identical to the first frame member 20, but merely reversely orientated. In an alternate embodiment the second frame member could be different from the first frame member. The second frame member 30 comprises a channel 32 for receiving an end of the second electrical conductor. The second frame member 30 also comprises an integrally formed wedge shaped section 34. The wedge shaped section 34 is configured for use with a wedge connector shell (not shown) for attaching the second electrical conductor to the second frame member. However, in alternate embodiments, any suitable system could be provided for attaching the second electrical conductor to the second frame member 20. The second frame member comprises two leg sections 36 and a bottom platform section 38.

The electrical insulating section 16, in this embodiment, comprises a plurality of insulators 40 arranged in two spaced rows. Each row of the insulators 40 is connected between a pair of the legs 28, 38. However, in alternate embodiments, any suitable electrical insulating section connecting the first and second frame members 20, 30 to each other could be provided.

The contact arm 18 is movable between the closed position shown in FIGS. 1-2 and an open position (see FIG. 15) to selectively electrically connect and disconnect the first and second frame members 20, 30 with each other. Thus, this can selectively connect and disconnect the first and second electrical conductors with each other. With the switch 10 connected to the ends of the first and second electrical conductors, the switch is able to be suspended between the two conductors.

Figure 3:
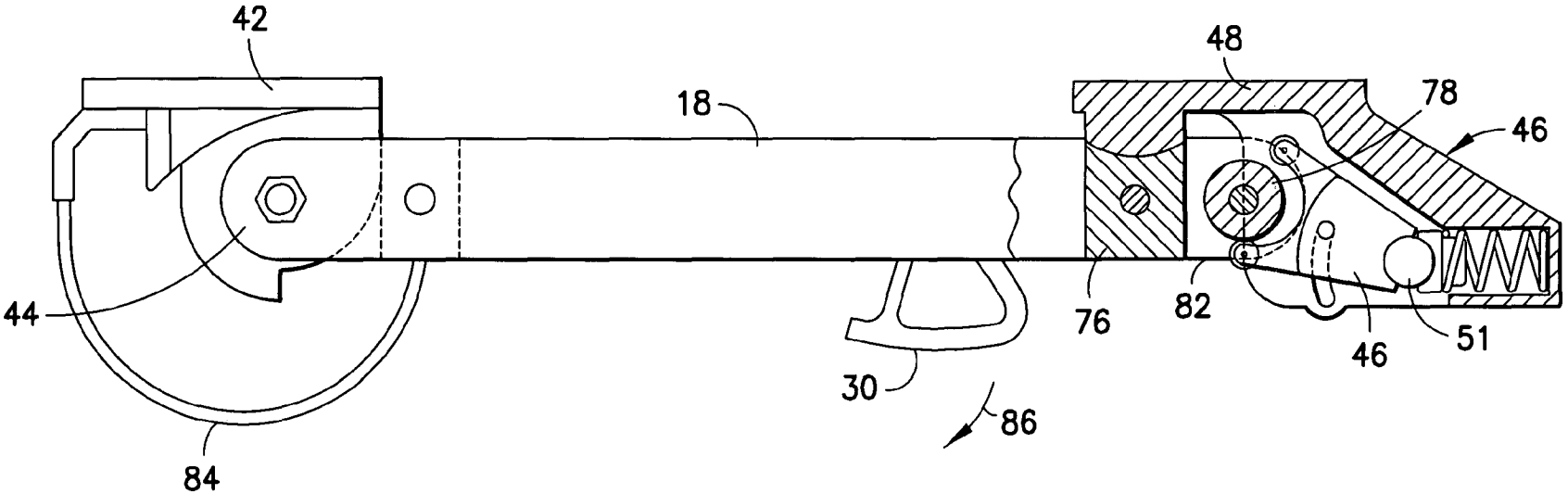
FIG. 3 is an enlarged side view of components of the apparatus shown in FIG. 1 with the contact arm in a fully closed position.
Figure 4:
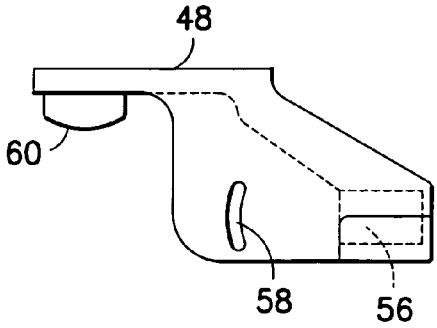
FIG. 4 is a side view of the cam housing shown in FIG. 3.
Figure 5:
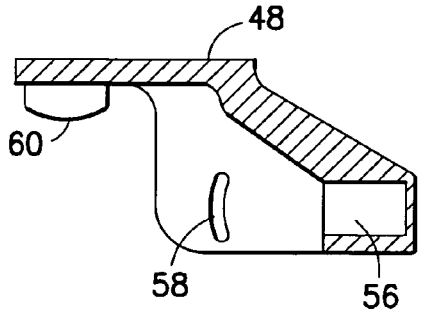
FIG. 5 is a cross sectional view of the cam housing shown in FIG. 4.
Figure 6:
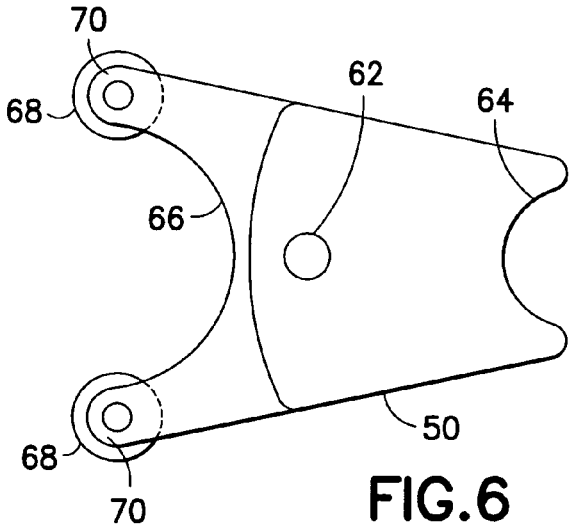
FIG. 6 is a side view of the cam member and rollers of the cam assembly shown in FIG. 3.
Figure 7:
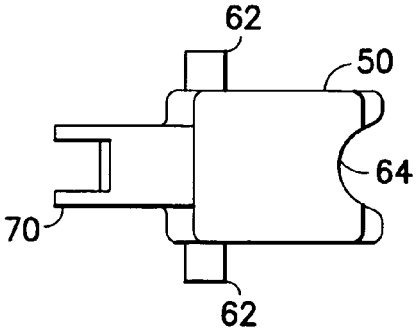
FIG. 7 is a top plan view of the cam member shown in FIG. 6.
Figure 8:
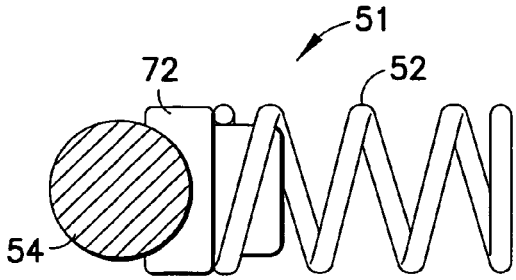
FIG. 8 is a side view of the ball/spring assembly shown in FIG. 3.
Figure 9:
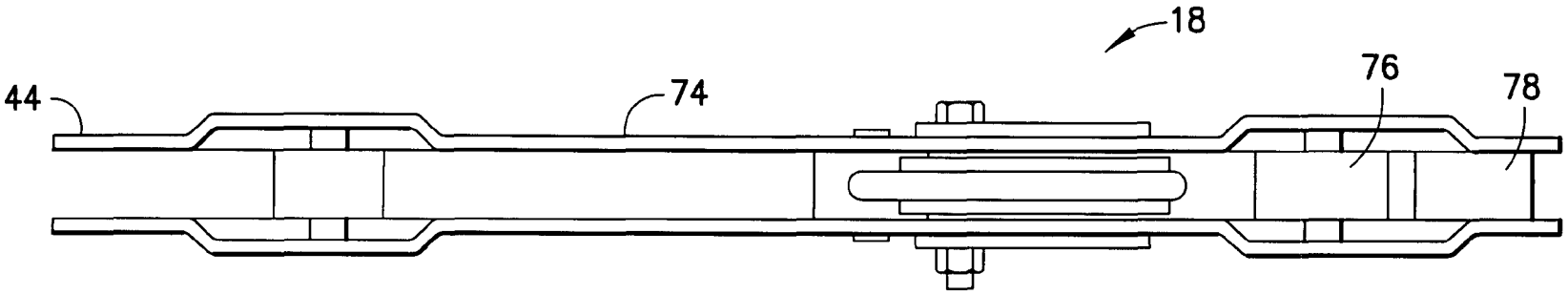
FIG. 9 is a bottom plan view of the contact arm shown in FIG. 3.
Figure 10:
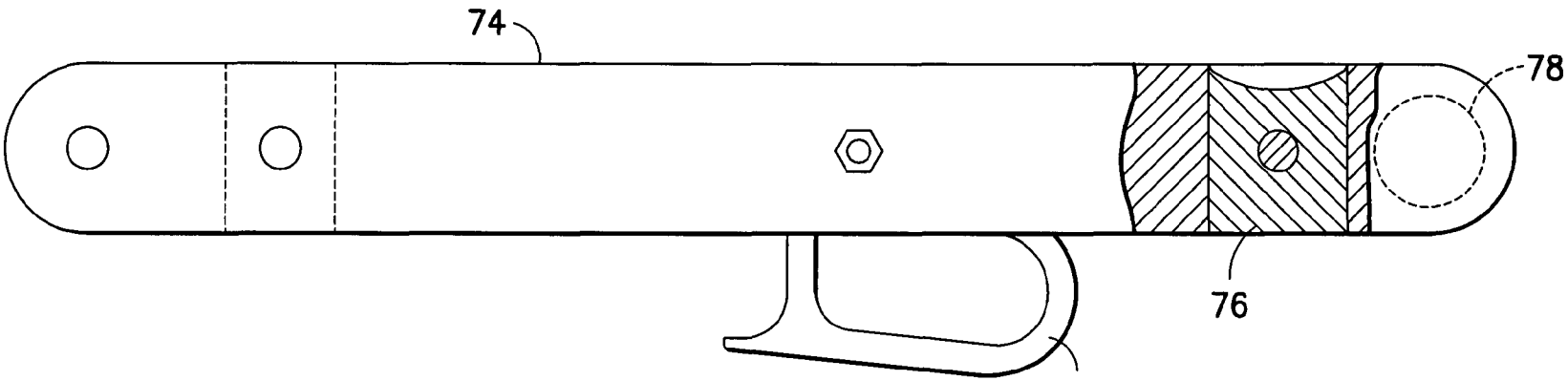
FIG. 10 is a side view of the contact arm shown in FIG. 9 with a cut away section.

Referring also to FIG. 3, the first section 12 includes a pivot mounting base 42. The pivot mounting base 42 is fixedly attached to the bottom side of the bottom platform section 28 of the first frame member 20. A first end 44 of the contact arm 18 is rotatably connected to the pivot mounting base 42. The second section 14 includes a cam assembly 46.

Referring also to FIGS. 4-8, the cam assembly 46 comprises a cam housing 48, a cam member 50, and a ball/spring assembly 51. The ball/spring assembly 51 comprises a spring 52 and a pivot member 54. The cam housing 48 is fixedly connected to the bottom platform 38 of the second frame member 30. However, in an alternate embodiment the cam housing could be integrally formed with the second frame member. The cam housing 48 comprises a spring receiving area 56, cam slots 58 and an electrical contact surface 60. However, in an alternate embodiment the electrical contact surface 60 could be formed on the second frame member.

The cam member 50 comprises side cam posts 62, a rear pivot surface 64, and a front cavity 66 with rollers 68 on opposite arms 70. The cam member 50 is movably mounted to the cam housing 48 with the cam posts 62 inside the cam slots 58. The cam member 50 and/or the rollers 68 can be comprised of a dielectric material, such as plastic.

The spring 52 comprises a coil compression spring. However, in an alternate embodiment any suitable type of spring could be provided. In this embodiment the spring 52 is located in the spring receiving area 56. The spring 52 biases a bushing 72 against the rear end of the pivot member 54. However, in an alternate embodiment the pivot member 54 might be integrally formed with the spring 52.

The pivot member 54 comprises a ball. The ball 54 is sandwiched between the front end of the bushing 72 and the rear pivot surface 64 of the cam member 50. However, in an alternate embodiment the pivot member could be integrally formed at the rear end of the cam member.

Referring also to FIGS. 9-12, the contact arm 18 comprises a frame 74, a contact plate 76 and a roller bushing 78. The frame 74 includes a handle 80. A first end 44 of the arm 18 is connected to the pivot mounting base 42. The opposite second end 82 of the arm 18 has the contact plate 76 and the roller bushing 78 mounted thereto. Referring also to FIGS. 13-14 a flexible electrical conductor or cable 84 electrically connects the arm 18 to the pivot mounting base 42. The contact plate 76 is comprised of electrically conductive metal. The top of the contact plate 76 is configured to contact the bottom of the contact surface 60 of the cam housing 48 when the arm 18 is in the fully closed position.

Figure 15:
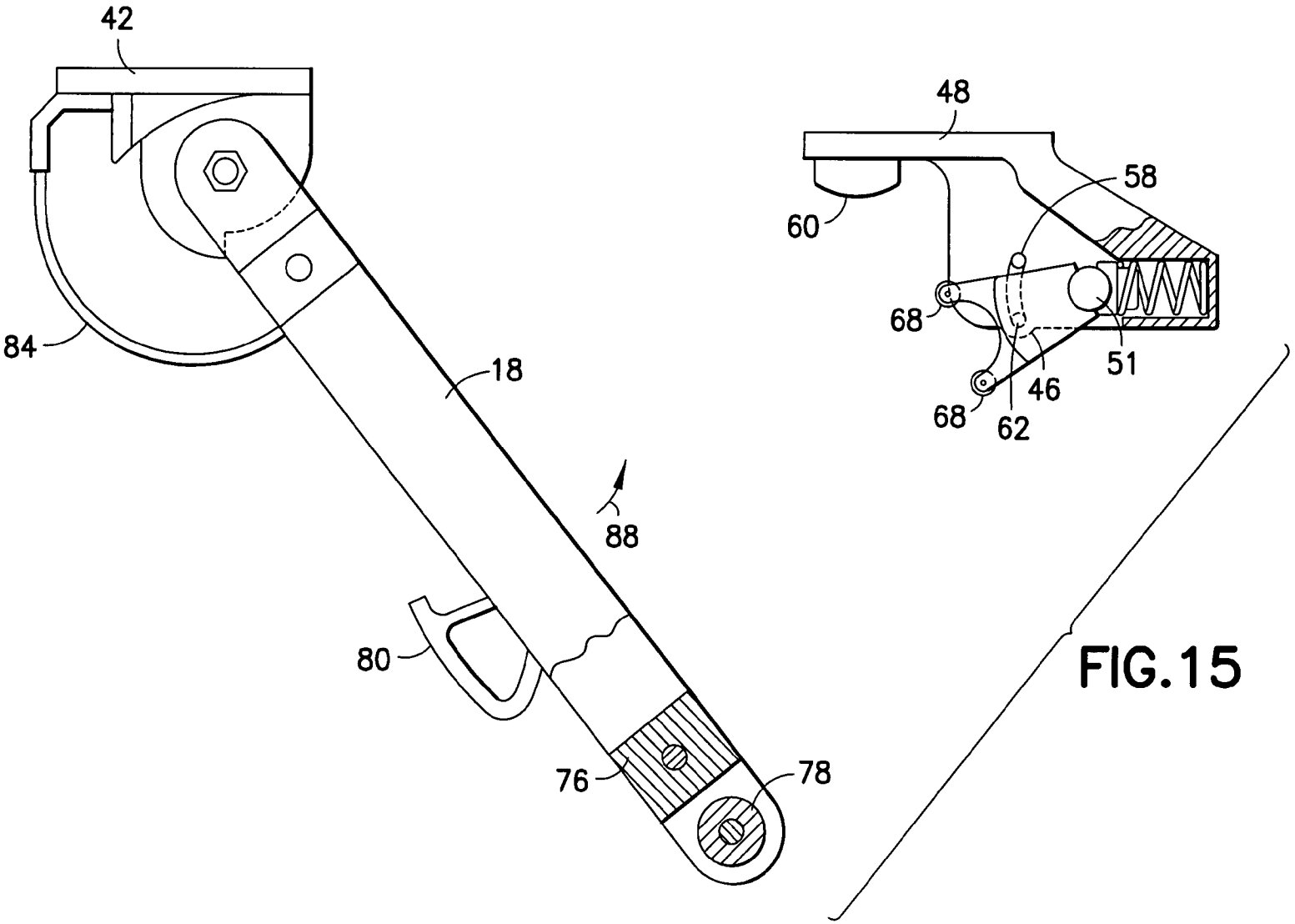
FIG. 15 is a side view of the components shown in FIG. 3 is a fully open position.

FIG. 3 shows the arm 18 in the fully closed position. In this position, the first and second sections 12, 14 are electrically connected to each other by means of the contact arm 18 and the cable 84. Referring also to FIG. 15, the contact arm 18 is shown in its fully open position. In this position, the first and second sections 12, 14 are not electrically connected to each other. The arm 18 is pivotal on the pivot mounting base 42 between the fully closed and fully open positions.

When the contact arm 18 is in the closed position as shown in FIG. 3 the bottom one of the rollers 68 contacts the roller bushing 78 and presses the roller bushing 78 upward. The cam posts 62 are located in the top ends of the cam slots 58. The rear end of the cam assembly 46 is biased downward due to contact with the ball/spring assembly 51. Thus, the connection of the cam assembly to the cam housing and the action of the ball/spring assembly 51 on the cam assembly, biases the contact plate 76 into contact against the contact surface 60.

When a user desires to disconnect the first and second conductors from each other, the user uses the handle 80 to pull on the contact arm 18 as indicated by arrow 86. As the contact arm 18 starts to move downward, the cam assembly 46 can both rotate and slide relative to the cam housing 48 with the cam posts 62 sliding and rotating in the cam slots 58. The ball/spring assembly 51 is initially compressed into the area 56 as the rear end of the cam member is slid rearward. The roller bushing 78 can roll against the rollers 68.

Figure 16:
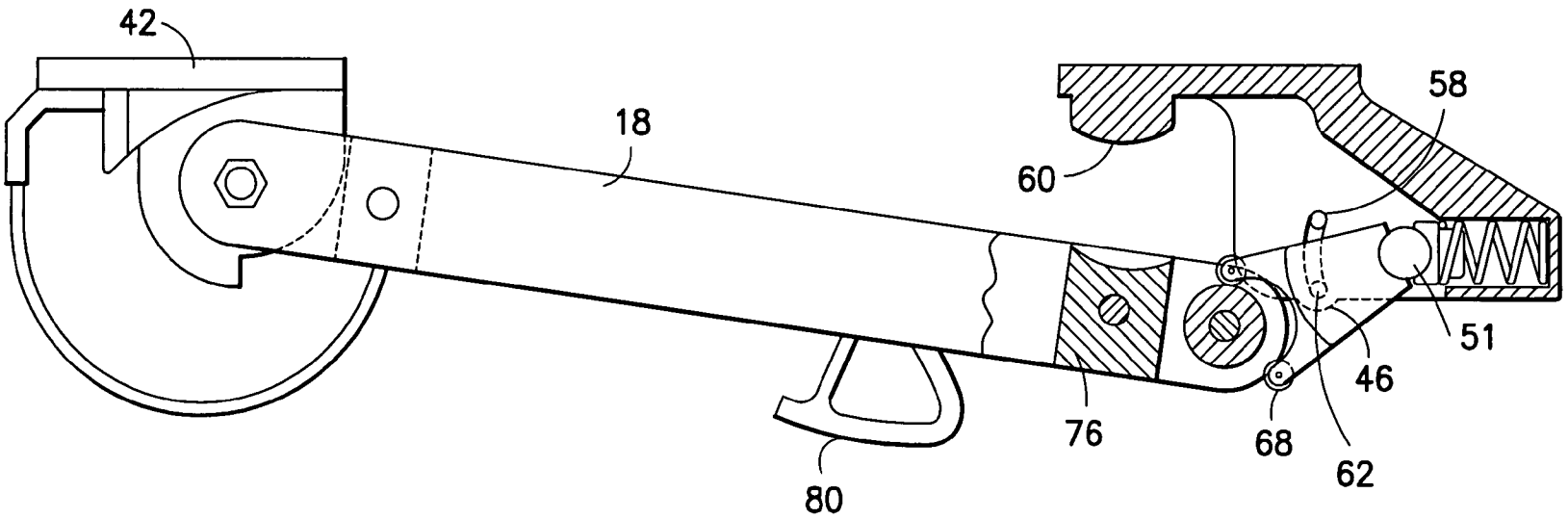
FIG. 16 is a side view of the components shown in FIGS. 3 and 15 is an intermediate position between the fully open and fully closed positions.

At about midway through the motion of the cam posts 62 in the slots 58, the forces acting on the roller bushing 78 change from an upward biasing force to a downward biasing force. As shown in FIG. 16, this causes the ball/spring assembly 51 to push the cam assembly 46 into the position shown with the cam posts 62 being biased into the bottom ends of the cam slots 58 and the front end of the cam assembly being pushed downward. The top one of the rollers 68 pushes against the top side of the roller bushing 78 to help push the end 82 of the contact arm away from the second section 14. The contact arm 18 is then easily moved to the fully open position shown in FIG. 15. Thus, the invention provides a means for assisting in disconnecting the contact arm from electrical connection with the second section.

This knife blade switch assembly is designed to reduce the amount of force required to open and close it. The knife blade has a pivot point, which allows the knife blade to act like a hinge. To open or close the knife blade the user can connect a tool to the pull handle. The knife blade is than pulled downward to open it. As the knife blade begins to open the roller bushing rolls on the bottom one of the rollers on the cam assembly. The cam roller is mounted on the cam assembly by means of a pin. As the knife blade continues to open the roller bushing applies more pressure against the cam roller and transfers the action to the cam assembly. The cam member has a pivoting point and allows the cam member to rotate in the cam housing. As the cam member rotates on the pivoting point it is guided by cam pins. The cam pins ride inside of the curved slots in the cam housing. The curved slots limit the travel of the cam pins. The cam member rotates until the top cam roller makes contact with the opposite side of the roller bushing. At this point the cam is at its rotating point between the cam pins and it's pivot point. Located at the back of the cam member there is a concave surface. The ball rides inside the surface. The opposite side of the ball rides in the socket or bushing. The socket has a protruding round boss that is inserted into the spring. The spring is held captive by spring receiving area in the cam housing. The spring applies force to the socket which transfers the force to the ball and than to the back of the concave surface in the back of the cam member. The force of the ball spring assembly rotates the cam at a higher movement and opens the knife blade at a faster rate.

This same action is reversed when the knife blade is being closed. The pivot point of the knife blade is design so that the knife blade can rotate freely with no significant resistance from the pivot joint. In order for the current to have a continuous path when the knife blade is in its close position, the cable or copper braded strap can be added to the assembly. When a user desires to connect the first and second conductors from each other, the user uses the handle 80 to push on the contact arm 18 as indicated by arrow 88. As the contact arm 18 moves upward, the roller bushing 78 moves into the front cavity 66 of the cam assembly 46 and into contact with the rollers 68 as shown in FIG. 16. Further motion in direction 88 causes the cam assembly 46 to both rotate and slide relative to the cam housing 48; with the cam posts 62 sliding and rotating in the cam slots 58. More specifically, the front end of the cam assembly rotates upward and the rear end of the cam assembly slides inward compressing the spring 52.

At about midway through the upward motion of the cam posts 62 in the slots 58, the forces acting on the roller bushing 78 change from a downward biasing force to an upward biasing force. This causes the ball/spring assembly 51 to push the cam assembly 46 into the position shown in FIG. 3 with the cam posts 62 being biased into the top ends of the cam slots 58 and the front end of the cam assembly being biased upward. The bottom one of the rollers 68 pushes against the bottom side of the roller bushing 78 to help bias the contact plate 76 into contact with the surface 60. The ball/spring assembly 51 keeps the cam assembly 46 in the position shown in FIG. 3 until the arm 18 is positively moved by the user. Thus, the invention provides a means for assisting in connecting the contact arm with the second section.

The invention can provide a knife switch type of apparatus which is designed to reduce the amount of effort to open and close the switch. In one embodiment it is designed to have a built-in spring located cantilever cam action. This built-in spring located cantilever cam action can assist in the opening and closing of the switch.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. An electrical switch comprising:

a first section;

a second section; and a contact arm rotatably connected to the first section, wherein an end of the contact arm is movable between an open position spaced from the second section and a closed position contacting the second section, wherein the second section comprises a cam assembly configured to assist in moving the end of the contact arm between the open and closed positions.

2. An electrical switch as in claim 1 wherein the first section comprises a first frame with an integral wedge section configured for use with a wedge connector shell for attaching a first electrical conductor to the first frame.

3. An electrical switch as in claim 1 further comprising an electrical insulator section connecting the first section to the second section.

4. An electrical switch as in claim 1 wherein the end of the contact arm comprises a contact plate member configured to directly contact a second frame member of the second section, and a roller bushing configured to be contacted by the cam assembly.

5. An electrical switch as in claim 1 wherein the cam assembly comprises a cam member movably connected to a cam housing, and a spring connected to the cam housing and acting upon the cam member.

6. An electrical switch as in claim 5 wherein the cam member is rotatably connected to the cam housing.

7. An electrical switch as in claim 6 wherein the cam member is slidably connected to the cam housing.

8. An electrical switch as in claim 7 wherein the cam member is movably mounted in a curved guide slot in the cam housing.

9. An electrical switch as in claim 5 wherein the cam assembly further comprises a pivot member directly biased by the spring against an end of the cam member.

10. An electrical switch as in claim 5 wherein the cam member comprises a slot adapted to receive a portion of the end of the contact arm therein, and rollers on opposite sides of the slot for contacting the portion of the end of the contact arm.

11. An electrical switch comprising:

a first section comprising a first frame configured to be connected to a first electrical conductor;

a second section comprising a second frame configured to be connected to a second electrical conductor;

an electrical insulator connected between the first and second sections such that the first section, the second section and the electrical insulator can be suspended in series between the first and second electrical conductors;

a contact arm pivotably connected to the first section, wherein an end of the contact arm is movable between a closed position relative to the second section to provide an electrical path between the first and second sections, and an open position relative to the second section, wherein the second section comprises a spring loaded cam assembly configured to assist in moving the end of the contact arm between the open and closed positions, wherein the cam assembly comprises a cam member slidably mounted to the second frame and a spring providing a biasing force against the second frame member.

12. An electrical switch as in claim 11 wherein the first frame comprises an integral wedge section configured for use with a wedge connector shell for attaching a first electrical conductor to the first frame.

13. An electrical switch as in claim 11 wherein the end of the contact arm comprises a contact plate member configured to directly contact a cam housing of the second section or the second frame, and a roller bushing configured to be contacted by the cam assembly.

14. An electrical switch as in claim 11 wherein the cam member is rotatably connected to a cam housing.

15. An electrical switch as in claim 14 wherein the cam member is movably mounted in a curved guide slot in a cam housing.

16. An electrical switch as in claim 11 wherein the cam assembly further comprises a pivot member directly biased by the spring against an end of the cam member.

17. An electrical switch as in claim 11 wherein the cam member comprises a slot adapted to receive a portion of the end of the contact arm therein, and rollers on opposite sides of the slot for contacting the portion of the end of the contact arm.

18. A method comprising:

providing a first electrical connection section comprising a first frame;

providing a second electrical connection section comprising a second frame and a cam assembly connected to the second frame;

rotatably connecting a contact arm to the first electrical connection section; and connecting the second electrical connection section to the first electrical connection section by an insulator section, wherein an end of the contact arm is movable between an open position spaced from the second section and a closed position contacting the second section, and wherein the cam assembly assists in moving the end of the contact arm between the open and closed positions.

19. A method as in claim 18 wherein providing the second electrical connection section comprises providing the cam assembly with a cam housing, a cam member and a spring acting between the cam housing and the cam member, wherein the cam member is movably mounted to the cam housing in a curved slot of the cam housing such that the cam member can slide and pivot relative to the cam housing.

20. A method as in claim 18 wherein providing the second electrical connection section comprises providing the cam assembly with a cam housing, a cam member and a spring acting between the cam housing and the cam member, wherein the cam member comprises a slot adapted to receive a portion of the end of the contact arm therein, and rollers on opposite sides of the slot for contacting the portion of the end of the contact arm.

* * * * *